United States Patent [19]

Mathiprakasam

[11] 4,430,864

[45] Feb. 14, 1984

[54] HYBRID VAPOR COMPRESSION AND DESICCANT AIR CONDITIONING SYSTEM

[75] Inventor: Balakrishnan Mathiprakasam, Overland Park, Kans.

[73] Assignee: Midwest Research Institute, Kansas City, Mo.

[21] Appl. No.: 336,280

[22] Filed: Dec. 31, 1981

[51] Int. Cl.[3] ..... F25D 17/06

[52] U.S. Cl. ..... 62/94; 62/324.1

[58] Field of Search ..... 165/133; 55/387, 390; 62/93, 94, 515, 324.1, 324.6, 324.7

[56] References Cited

U.S. PATENT DOCUMENTS

| | | | |
|---|---|---|---|
| 4,180,985 | 1/1980 | Northrup, Jr. | 62/94 |
| 4,240,269 | 12/1980 | Bussjager | 62/324.1 X |
| 4,255,171 | 3/1981 | Draunieks | 55/390 X |
| 4,290,789 | 9/1981 | Newton | 55/390 X |

*Primary Examiner*—Lloyd L. King

*Attorney, Agent, or Firm*—D. A. N. Chase; Michael Yakimo, Jr.

[57] ABSTRACT

An air conditioning system utilizes a novel air thermodynamic cycle and performing apparatus for simultaneous and efficient removal of the sensible and latent heats from the room return air. The system employs a pair of heat exchangers having a desiccant material thereon, the refrigerant, room and outside ambient air flows being selectively routed to the heat exchangers to allow one heat exchanger to operate as an evaporator to effect cooling and drying of the room return air while the other heat exchanger acts as a condenser of the refrigerant and regenerates the desiccant material thereon. The heat exchangers are switchable between evaporator and condenser modes allowing for continuous conditioning of the room return air.

9 Claims, 4 Drawing Figures

Fig. 1.
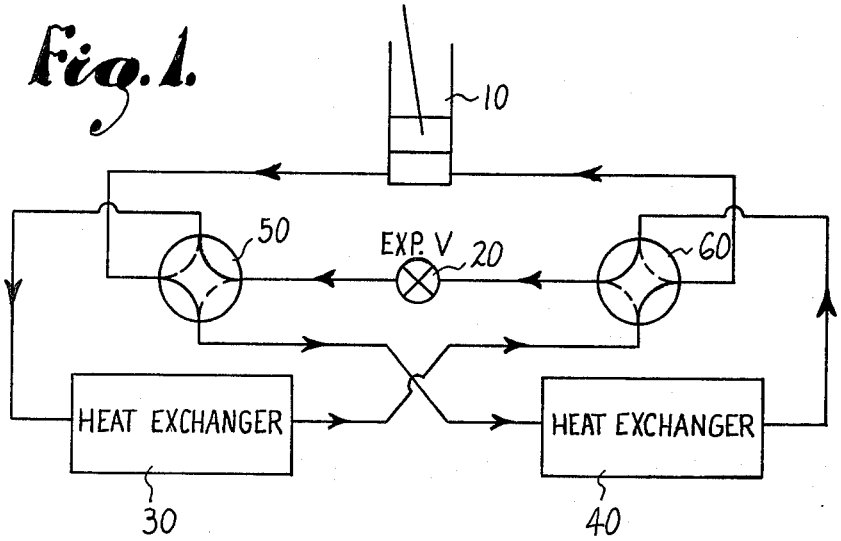
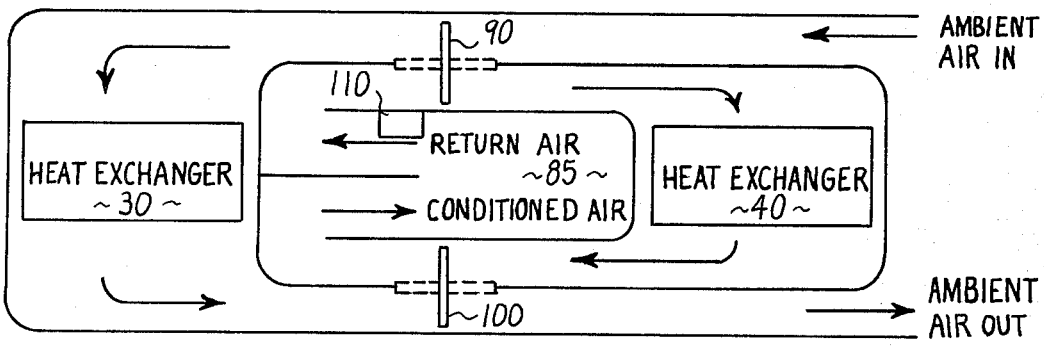
Fig. 2.
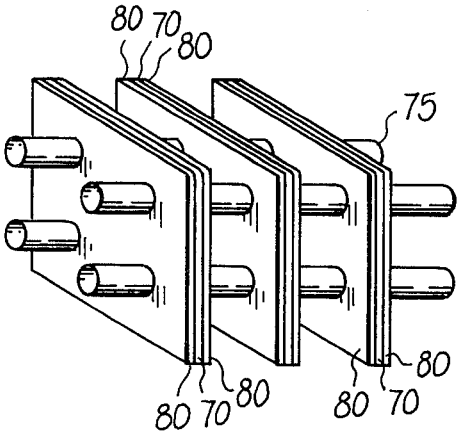
Fig. 3.

HYBRID VAPOR COMPRESSION AND DESICCANT AIR CONDITIONING SYSTEM

BACKGROUND OF THE INVENTION

This invention relates to an improved air conditioning system and more particularly to a system utilizing a novel air thermodynamic cycle and performing apparatus providing for simultaneous and efficient removal of the sensible and latent heats from the air to be conditioned.

Heretofore, the standard thermodynamic cycle of an air conditioning system utilized the vapor compression cycle which conditioned the room return air to a predetermined cooler temperature and a less humid state prior to injection back into the room/space. This cycle included a first step in which the return air underwent a sensible cooling operation beyond the desired lower temperature to the dew point temperature of the air. This extended sensible cooling step was followed by condensation of the sensibly cooled air so as to provide for removal of the latent heat therein, and thus arrive at the desired lower humid state. The air is then reheated to arrive at the desired temperature state before injection into the room/space—this step being an optional one. This system requires an excessive cooling/sensible heat removal of the processed air to a temperature lower than that of the desired temperature parameter. This extra cooling requires a lower evaporating temperature of the refrigerant in the evaporator apparatus resulting in a lower coefficient of performance of the system.

A desiccant cycle has also been employed in an air conditioning system. This cycle included a first step in which the moisture of the return air is removed by interaction with a desiccant material, such moisture removal resulting in an increase in the air temperature. This dehumidification is followed by a cooling step in which the dried air is sensibly cooled by a heat exchange with the ambient air saturated with water. Once cooled, an adiabatic humidification step is provided by adding moisture to the air which also cools the processed air whereby to condition the room air to the desired temperature and humidity parameters prior to injection back into the room/space. In this process, an excessive moisture removal/latent heat removal from the air is required beyond the desired humidity parameter so that the sensible cooling step can be performed without the use of a refrigerant. This excessive drying step, however, requires excessive thermal energy for regenerating the desiccant. Thus, the operating efficiency of the common desiccant cycle is low.

Thus, it is appreciated that in both of the known air conditioning systems respectively utilizing the vapor compression and desiccant cycles energy is not efficiently utilized to arrive at the desired state of the conditioned air which is to be injected into the living area.

Accordingly, addressing this waste of energy, I have invented an air conditioning system and performing apparatus utilizing a new air thermodynamic cycle which simultaneously cools the return air to the extent required to only cover the desired sensible heat loss while drying this air to the extent required only to cover the latent heat loss corresponding to the desired removal of moisture therefrom. Thus, an air thermodynamic cycle presenting a simutaneous and direct cooling and dehumidification of the air is provided without waste of energy therein.

The performing apparatus includes first and second heat exchangers having a heat exchange surface of interaction such as projecting fins with the fins further having a desiccant material thereon. The first and second heat exchangers are switchable between condenser and evaporator modes as provided by controlled routing of the refrigerant and the room return and outside ambient air. In the evaporator mode one heat exchanger simultaneously cools and dries the return air. The other heat exchanger being in a condenser mode removes the heat of the compressed refrigerant to atmosphere via a heat exchange with the ambient air which concurrently regenerates the desiccant material thereon. Accordingly, the performing apparatus enables the room return air to be continuously and simultaneously conditioned to the preselected parameters without the need of inefficient cooling and/or drying beyond the desired temperature or absolute humidity of the conditioned air. Thus, the utilization of the thermal energy in the process is highly efficient lending to an energy efficient air conditioning system.

It is therefore a general object of this invention to provide an improved, energy efficient air conditioning system utilizing a novel air thermodynamic cycle and performing apparatus which simultaneously cools and dries the room return air, and thus conditions said air to selected states of temperature and humidity.

Another object of this invention is to provide an air conditioning system, as aforesaid, which removes the sensible heat of the return air, i.e., temperature cooling, only to the extent required to reach the desired temperature of the conditioned air.

Another object of this invention is to provide an air conditioning system, as aforesaid, which removes the latent heat of the room return air, i.e., moisture removal, only to the extent required to reach the desired humidity of the conditioned air.

Still another object of this invention is to provide performing apparatus for the air conditioning system, as aforesaid, having first and second heat exchangers equipped with a desiccant material thereon for moisture removal/drying of the room air.

A further object of this invention is to provide performing apparatus, as aforesaid, which has control means therein for selectively routing the refrigerant and room and outside ambient air to the selected heat exchangers to allow the heat exchangers to operate in either condenser or evaporator modes relative to the refrigerant and room and ambient air passing therethrough.

A particular object of this invention is to provide performing apparatus, as aforesaid, wherein one heat exchanger is in the evaporator mode and removes the sensible heat from the room return air with its desiccant simultaneously removing the latent heat therefrom.

Another particular object of this invention is to provide a performing apparatus, as aforesaid, wherein the other heat exchanger is in the condenser mode and in heat exchange with a fluid such as the outside ambient air thereby providing for condensation of the refrigerant with a concurrent drying and regeneration of the desiccant material thereon.

Still another object of this invention is to provide a performing apparatus, as aforesaid, which efficiently uses the thermal energy produced therein and thus achieves a high coefficient of performance.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is a diagrammatic view illustrating the components of the performing apparatus of my air conditioning system including the valved controlled refrigerant paths for routing the refrigerant in a selected sequential manner through the heat exchangers.

FIG. 2 is a diagrammatic view showing air flow paths of the ambient and room return air to the heat exchangers, as controlled by the first and second dampers shown in a first solid line position with an alternative phantom line position illustrated therein.

FIG. 3 is a partial perspective view illustrating the mounting of the desiccant material to the fins of the heat exchanger.

DESCRIPTION OF THE PREFERRED EMBODIMENT

Figure 4:
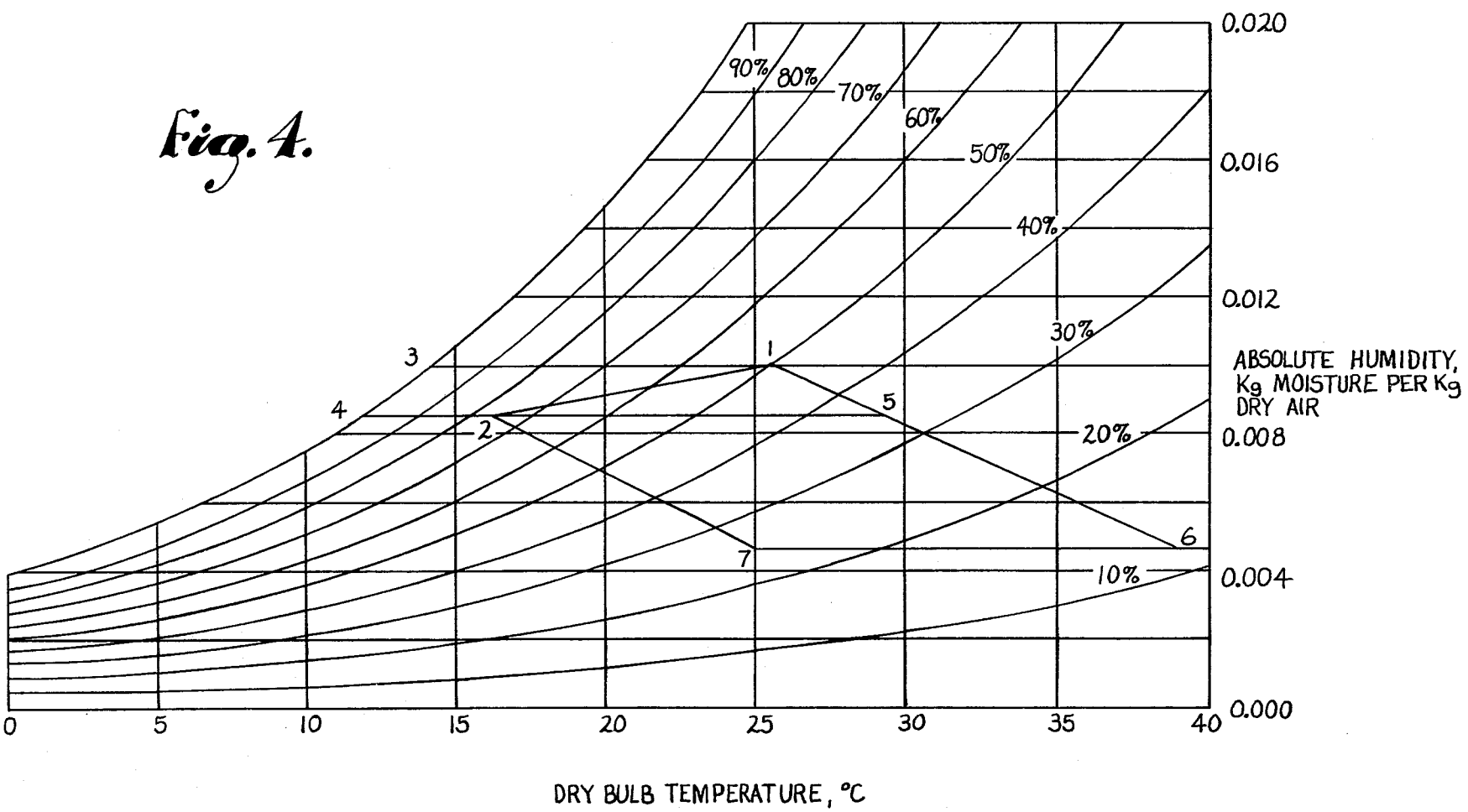
FIG. 4 is a graph of dry bulb temperature versus absolute humidity of the processed air with the outside air assumed to be approximately 29° C. and fifty percent (50%) relative humidity and showing therein a vapor compression cooling cycle as illustrated by points 1-3-4-2, a desiccant cooling cycle along the lines 1-6-7-2 and my novel cooling cycle as indicated by the line 1-2.

Referring more particularly to the drawings, FIG. 4 graphically shows three air thermodynamic cycles of associated air conditioning systems. Point 1 thereon designates the temperature and humidity parameters of the room return air to be conditioned in each air conditioning system as measured by the dry bulb temperature (° C.) on the horizontal scale and the absolute humidity (Kg Moisture/Kg Dry Air) on the vertical scale with a range of incremental (10%) relative humidity curves located thereon. It has been assumed that the ambient air is at approximately 29° C. (84° F.) on the 50% relative humidity curve.

The conditioning of room air by utilization of the standard vapor compression cycle is as shown by the cycle 1-3-4-2. Accompanying the cycle is the performing apparatus for compression, condensation and evaporation of the refrigerant fluid with the evaporation of the refrigerant being the critical step in extracting sensible and latent heat from the air to be conditioned. Therein, the room air is ultimately cooled and dried to the parameters shown at point 2 for injection back into the room/conditioned space. In order to arrive at the parameters of point 2 a removal of both the sensible heat and latent heat of the room air, as defined at point 1, is required as measured by a reduction in the dry bulb temperature and a reduction in absolute humidity. As shown, the sensible heat of the room return air is removed in step 1-3 with the latent heat removed during step 3-4. A reheat process is shown as step 4-2. This reheat step is optional and is used in situations where the sensible heat ratio must be strictly maintained. However, this step is not normally used in domestic air conditioning systems.

In order to achieve the desired state at point 2 of a relatively lower absolute humidity, it is necessary to condense the moisture present in the room return air prior to removal therefrom. Thus, cooling of the room return air to its dew point temperature so that the return air will give up its moisture is required, such dew point temperature being lower than the desired temperature parameter of point 2. This dew point cooling requires an excessive removal of sensible heat from the room return air beyond that needed to reach the temperature parameter of point 2. A lower evaporating temperature of the refrigerant is thus required, in turn requiring more work to be done in the standard vapor compression cycle which ultimately reduces the coefficient of performance of the system.

Accordingly, this reduction of the coefficient of performance is directly linked to the requirement of moisture/latent heat removal from the room return air. It is thus desirable to have a vapor compression system that needs to remove only that sensible heat, i.e., cooling, from the room return air needed to reach the desired temperature so that the required evaporating temperature of the refrigerant can be as high as possible which thus results in a higher coefficient of performance. Therefore, one can conclude that in an air conditioning system utilizing a standard vapor compression cycle that the removal of the sensible heat load from the air to achieve a desired temperature is an energy efficient process, whereas the removal of latent heat from the same air to achieve a desired humidity parameter is less energy efficient.

An alternative air conditioning cycle for providing air cooling and drying has been utilized and is herein called a desiccant air conditioning cycle. This cycle is represented by the steps 1-6-7-2 in FIG. 4 with point 1 designating the return room air parameters and point 2 again designating the state of the conditioned air after processing. In step 1-6 the room return air is first dried in a desiccant bed so as to reach the humidity parameter at point 6. The removal of moisture from the air by absorption with the desiccant concurrently results in an increase of the dry bulb temperature of the air. The air at stage 6 is then sensibly cooled to the temperature parameter at point 7 by a heat exchange transaction with outside ambient air saturated with water. The air at point 7 then undergoes an adiabatic humidification process along step 7-2 in which the air is also evaporatively cooled by the addition of moisture thereto to reach the desired parameters of the conditioned air at point 2.

Of importance is that the drying process of step 1-6 in this desiccant cycle could not stop at point 5 as cooling of the air at point 5 to the desired conditioned state at point 2 could not have been achieved with the saturated ambient air having the above assumed parameters. Thus, a refrigerant cooling of the air would have been required to go directly from point 5 to point 2.

Accordingly, the drying of air to a temperature at point 6 to avoid refrigerant cooling requires the extended use of the desiccant resulting in a high moisture content being absorbed therein. Thus, for a continuously effective functioning of the desiccant, regeneration of the desiccant bed is required. The amount and quality of thermal energy required for desiccant regeneration is a function of the extent of drying of the air required. Therefore, a large amount of thermal energy at a fairly high temperature is needed for the desiccant regeneration. Accordingly, it can be appreciated that the portion of the drying step 1-6 extending beyond point 5 in order to avoid refrigerant cooling affects the efficiency of the desiccant air conditioning cycle. It can thus be concluded that in an air conditioning system utilizing a desiccant air conditioning cycle that the removal of the temperature/sensible heat load of the room return air is less energy efficient than the removal of the moisture/latent heat load alone.

Accordingly, I have found that a hybrid cycle utilizing vapor compression for sensible heat removal and desiccant drying for latent heat removal is desired. This hybrid system utilizes the most efficient steps of the vapor compression cycle and the desiccant cycle i.e., vapor compression cooling for sensible heat removal and desiccant drying for latent heat removal. Although the step 1-5 is an efficient drying process and the step 5-2 is an efficient cooling process, the optimal path for air conditioning is along my novel cycle as graphically defined by the line 1-2 in which a sensible cooling of the room air only to the extent required to remove the sensible heat and drying only to the extent required to remove the latent heat is simultaneously achieved. At a given absolute humidity the drying of the air can be done more effectively if the air is at a low temperature. Thus, the drying process along path 1-2 is more efficient than that along 1-5 in which the temperature of the air is increasing. Thus, the optimal path for both sensible and latent heat removal, i.e., temperature cooling and moisture removal/dehumidification, is that along 1-2 which requires a simultaneous removal of the sensible and latent heats. Accordingly, I have provided apparatus for an air conditioning system for simultaneously processing the room return and conditioned air along this optimal path.

The preferred apparatus for implementing this air conditioning system and the optimal air conditioning cycle 1-2 is as diagrammatically shown in FIGS. 1 and 2. Referring to the refrigerant flow diagram (FIG. 1), a compressor 10, a throttling expansion valve 20 and first and second heat exchangers 30 and 40 are illustrated. First and second four-way valves 50 and 60 are utilized which control the route of the refrigerant from the compressor 10 to the heat exchangers 30 and 40 in a sequential manner allowing for an interchange of the heat exchangers between normal condenser and evaporator modes. The refrigerant flow diagram in FIG. 1 shows a first path routed along the solid lines in the four-way valves 50 and 60 and a second path routed along the phantom lines in these valves.

Conventional heat exchangers similar to those employed in heat pumps are used which consist of a blower (not shown) and a refrigerant coil 75 (FIG. 3), commonly referred to as the cooling coal, with a plurality of metal fins 70 projecting therefrom to provide a greater heat exchange surface area. In my novel system I attach to these conventional metal fins 70 a desiccant material in the form of layered sheets 80. I utilize a desiccant consisting, for example, of a mixture of silica gel, Teflon (about 5%) and ammonium bicarbonate. These are initially mixed to provide a paste-like compound which is then rolled into sheets and heat treated. The finished sheets are then attached to the opposed faces of each fin 70 as shown in FIG. 3.

Corresponding air flow paths for the room return and conditioned air and ambient air are shown in FIG. 2. The living space is represented at 85, and the flow of air to and from space 85 is via the ductwork diagrammatically represented. Dampers 90 and 100 are utilized to route the air flow into selected manners of heat exchange with exchangers 30 and 40. A first air path is shown with the dampers 90 and 100 in their solid line positions, this air path corresponding to the solid line refrigerant path shown in FIG. 1. Likewise, to establish a second air path, the dampers at their phantom line positions in FIG. 2 correspond to the routing of the refrigerant along the phantom line path in FIG. 1.

Initially, as shown in FIG. 1, the heat exchanger 40 receives the compressed refrigerant from compressor 10 with the outside ambient air being in a heat exchange transaction therewith. Thus, the heat exchanger 40 condenses the refrigerant which is then routed through valves 60 and 50 via expansion valve 20 to the heat exchanger 30. The return air from the room is passed over the heat exchanger 30 which thus acts as an evaporator removing the sensible heat therefrom. Concurrently, the room air passes across the desiccant sheets on heat exchanger 30/evaporator which dries the air. The ambient air being drawn across the heat exchanger 40/condenser removes the latent heat from the refrigerant resulting in an increase in ambient air temperature which is used to dry the desiccant thereon. This hot and humid air resulting from the ambient air exchange with the heat exchanger 40/condenser is then returned to the atmosphere.

After a period of time, depending on the moisture in the air to be conditioned, the desiccant material of the heat exchanger 30/evaporator will become moistened resulting in a decrease of its drying efficacy. The room return air is monitored by humidistat 110 as to humidity to determine desiccant efficacy. Upon the room return air reaching a preselected humidity, it is necessary to change the functions of the heat exchangers 30 and 40 so that the heat exchanger 30/evaporator now becomes a condenser with accompanying drying of the moist desiccant material thereon. The heat exchanger 40/condenser must now function as the evaporator. This is provided by movement of the valves 50 and 60 and dampers 90 and 100 to their phantom line position. Accordingly, the room return air is now routed to the heat exchanger 40 with the ambient air now being routed to heat exchanger 30.

Concurrently, the refrigerant from compressor 10 is sequentially routed to heat exchanger 30 for interaction with the outside ambient air to perform the condenser function. Heat exchanger 40 now receives the cold refrigerant for interaction with the room air and thus now acts as an evaporator that removes the sensible heat therefrom. A simultaneous drying of the room air by the dry desiccant on heat exchanger 40 is also achieved. Therefore, cooling and drying of the air takes place in heat exchanger 40 with heating of the ambient air and regeneration of the desiccant 80 now taking place in heat exchanger 30. Subsequent processing continues until humidistat 110 again senses an increase to the preselected humidity level which then, by conventional solenoid and motor controls (not shown), moves the valves 50 and 60 and dampers 90, 100 to the first-discussed, solid line positions.

It is also understood that the above-described air conditioning system can also be used in the winter for delivery of useful heat to the room. In such a function the four-way valves 50 and 60 are placed in their solid line position and the dampers 90 and 100 are moved to their phantom line position. If heating and humidification are required, the valves and dampers can be alternatively cycled between these positions and a second state in which the valves are in the phantom line and the dampers in the full line positions. If no humidification is required, the valves 50, 60 and dampers 90 and 100 remain in the first stated positions.

It is to be understood that while certain forms of this invention have been illustrated and described, it is not limited thereto, except insofar as such limitations are included in the following claims.

Having then described the invention, what is claimed as new and desired to be secured by Letters Patent is:

1. An air conditioning process for room air comprising the steps of:

(a) providing first and second heat exchangers each having a desiccant therein disposed for thermal contact with a selected fluid flow;

(b) providing a refrigerant;

(c) compressing said refrigerant;

(d) routing said compressed refrigerant through a selected heat exchanger;

(e) concurrently routing a fluid flow to the heat exchanger of step d in a manner to condense said refrigerant with rejected heat resulting from said condensation simultaneously regenerating said associated desiccant;

(f) conveying said condensed refrigerant to the other heat exchanger;

(g) routing the room air at first temperature and humidity levels to said other heat exchanger receiving said condensed refrigerant in a manner to evaporate said refrigerant by the removal of sensible heat from said room air with said desiccant simultaneously removing the latent heat of said room air whereupon said temperature and humidity levels of said room air are simultaneously reduced from said first temperature and humidity levels to second temperature and humidity levels;

(h) returning the processed air of step g to said room;

(i) denoting one of said exchangers as the selected heat exchanger in step d; and (j) repeating steps c through i whereby to continuously condition said air.

2. The process as set forth in claim 1, wherein said step i of denoting one of said exchangers as a selected heat exchanger comprises the steps of:

monitoring the efficacy of said desiccant on said other heat exchanger receiving said conveyed condensed refrigerant on said room air routed thereto; and denoting the other of said heat exchangers as the selected heat exchanger in said d upon a selected decrease of said efficacy whereby said desiccant is regenerated in step e.

3. The process as claimed in claim 2, wherein said step of monitoring said efficacy of said desiccant includes the measurement of the relative humidity of said room return air prior to said routing of said room air thereto with an increase in said relative humidity indicating said decrease of desiccant efficacy.

4. The process as claimed in claim 1, wherein said fluid flow is the outside ambient air.

5. An air conditioning process comprising the steps of:

(a) providing first and second heat exchangers each having a desiccant therein disposed for simultaneous thermal contact with a fluid flow undergoing a heat exchange with said heat exchangers;

(b) providing a heat exchange medium;

(c) routing said heat exchange medium through a selected heat exchanger;

(d) concurrently passing a fluid flow through the exchanger of step c in a manner to condense said medium, whereby to heat said fluid flow and concurrently dry said desiccant thereon;

(e) conveying said condensed heat exchange medium to the other heat exchanger;

(f) conveying room air at a greater temperature level then said condensed medium to said heat exchanger receiving said condensed heat exchange medium in a manner to remove by a heat exchange therebetween sensible heat from said room air with said desiccant simultaneously removing latent heat of said room air therefrom corresponding to a simultaneous cooling and dehumidification of said room air;

(g) returning the processed air of step f to said room;

(h) denoting one of said exchangers as the selected heat exchanger in step c; and (i) repeating said steps c through h whereby to continuously condition said air.

6. A process for air conditioning a room or other space comprising the steps of:

(a) providing first and second heat exchangers including a desiccant material disposed on each heat exchanger and in thermal contact with a fluid flowing therethrough;

(b) providing a fluid heat exchange medium;

(c) passing said heat exchange medium through a selected heat exchanger;

(d) interacting a first fluid flow in said selected heat exchanger with said medium in a manner to heat said fluid flow, cool said medium and simultaneously dry said desiccant therein;

(e) conveying said cooled heat exchange medium to the other heat exchanger;

(f) interacting a second fluid flow in said other heat exchanger with said cooled medium in a manner to remove sensible heat from said second fluid flow with said desiccant simultaneously removing the latent heat therefrom;

(g) conveying the processed fluid of step d or f to said room depending on whether heating or cooling of said room is desired;

(h) denoting one of said heat exchangers as the selected exchanger in step d; and (i) repeating said steps c through h whereby to continuously condition said fluid flows.

7. An air conditioning system comprising:

compressor means having a refrigerant functionally passing therethrough;

first and second heat exchangers disposed in thermal contact with a selected fluid flow;

desiccant material on each heat exchanger and disposed in thermal contact with said selected fluid flow;

conveyance means for directing the compessed refrigerant and a heat exchange fluid to one of said heat exchangers to operate said one heat exchanger as a condenser of said refrigerant with the rejected heat of said condensation concurrently drying said desiccant material thereon, said conveyance means further directing said condensed refrigerant and a room return air flow at a preselected temperature and humidity to operate the other heat exchanger as an evaporator and dehumidifier for conditioning said return air flow by the simultaneous removal of the sensible and latent heats therefrom; and control means for alternating the modes of operation between said heat exchangers to provide for a simultaneous cooling and dehumidification of said return air flow through either of said heat exchangers and a drying of said desiccant on the other of said heat exchangers upon said relative operations in said evaporator and condenser modes.

8. The system as claimed in claim 7, wherein said conveyance means comprises:

conduit means for circulating said refrigerant from said compressor means and routing said refrigerant between said heat exchangers; and duct means for circulating said heat exchange fluid to said heat exchanger operating as said condenser and said room return air flow to said heat exchanger operating as an evaporator.

9. The system as claimed in claim 8, wherein said control means comprises:

valve means selectively positioned in said conduit means for alternating the sequential route of said refrigerant between said heat exchangers; and damper means selectively positioned in said duct means to route said room air to said heat exchanger operable as an evaporator and said heat exchange fluid to said heat exchanger operable as a condenser to provide for said alternating modes of heat exchanger operation.

* * * * *